US010782099B2

(12) United States Patent
Zimmer

(10) Patent No.: US 10,782,099 B2
(45) Date of Patent: Sep. 22, 2020

(54) ADAPTER PLATE SYSTEM FOR MOUNTING OPTICAL SIGHTS

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 0 days.

(21) Appl. No.: 16/280,087

(22) Filed: Feb. 20, 2019

(65) Prior Publication Data

US 2019/0257620 A1 Aug. 22, 2019

Related U.S. Application Data

(60) Provisional application No. 62/632,458, filed on Feb. 20, 2018.

(51) Int. Cl.

| | |
|---|---|
| ***F41G 11/00*** | (2006.01) |
| ***F41G 1/00*** | (2006.01) |
| ***F41C 3/00*** | (2006.01) |

(52) U.S. Cl.

CPC ..... *F41G 11/001* (2013.01); *F41C 3/00* (2013.01); *F41G 11/002* (2013.01); *F41G 11/003* (2013.01)

(58) Field of Classification Search

CPC .... F41G 11/001; F41G 11/002; F41G 11/003; F41G 11/006; F41G 1/30; F41G 1/16; F41C 3/00; Y10T 29/49826

USPC ..... 42/113, 111, 118, 131; 29/428

See application file for complete search history.

(56) References Cited

U.S. PATENT DOCUMENTS 4,021,954 A * 5/1977 Crawford ..... F41G 11/003 42/127
4,934,085 A * 6/1990 Lough ..... F41G 11/003 42/124
6,327,806 B1 12/2001 Paige
7,946,074 B2 5/2011 Nemec
8,832,983 B1 9/2014 Wolf
9,062,936 B2 6/2015 Zimmer
9,410,770 B2 8/2016 Zimmer
9,696,114 B1 * 7/2017 Cabrera ..... F41G 1/17
2005/0057808 A1 3/2005 Houde-Walter
2007/0234625 A1 10/2007 Kidd
2008/0062487 A1 3/2008 Houde-Walter
2013/0219767 A1 8/2013 Peterson et al.
2013/0283660 A1 10/2013 Matthews et al.
(Continued)

OTHER PUBLICATIONS

Mr. Grouchy (John), mini-RDS going mainstream with the FNP 45 Tactical [online], [dated Oct. 28, 2010], [retrieved on Jun. 10, 2016], Retrieved from the internet: <URL: http://www.mrgrouchy.com/2010/10/28/mini-rds-going-mainstream-with-the-fnp-45-tactical/>.
(Continued)

*Primary Examiner* — Michael D David
(74) *Attorney, Agent, or Firm* — Asgaard Patent Services, LLC; F. Wayne Thompson, Jr.

(57) ABSTRACT

Implementations of an adapter plate system for mounting optical sights on a pistol are provided. In general, the adapter plate system comprises an adapter plate configured so that an optical sight can be mounted thereon and a pistol slide having an adapter interface configured to receive the adapter plate. The adapter plate can be rotated into position between end walls of the adaper interface. An example adapter interface may include a pivot boss that extends up from the bottom surface thereof. The pivot boss is positioned to be received within a pivot bore located in the underside of an example adapter plate.

24 Claims, 10 Drawing Sheets

(56) References Cited

U.S. PATENT DOCUMENTS

| | | | | |
|---|---|---|---|---|
| 2014/0109456 | A1 | 4/2014 | Jung et al. | |
| 2014/0150325 | A1 | 6/2014 | Keng et al. | |
| 2014/0230305 | A1 | 8/2014 | Zimmer | |
| 2014/0298703 | A1* | 10/2014 | Gale | F41C 27/00 42/71.02 |
| 2015/0276350 | A1 | 10/2015 | Zimmer | |
| 2017/0059277 | A1* | 3/2017 | Justice | F41G 11/003 |
| 2019/0041162 | A1* | 2/2019 | Cabrera | F41G 1/10 |
| 2019/0331461 | A1* | 10/2019 | Zimmer | F41G 11/003 |

OTHER PUBLICATIONS

Jeff Compoc, FNH USA's FNP-45 Tactical [online], [dated Aug. 8, 2010], [retrieved on Jun. 10, 2016], Retrieved from the internet: <URL: http://gunblog.com/fnh-tactical-45>.

FNP-45 Tactical [online], [dated Jan. 18, 2010], [retrieved on Jun. 10, 2016], Retrieved from the Internet: <URL: http://soldiersystems.net/tag/fnh-usa/page/3/>.

David Crane, FN FNX-45 Tactical .45 ACP Polymer-Framed Combat/Tactical Pistol with Trijicon RMR (Ruggedized Miniature Reflex) RM02 Mini-Red Dot Optical Sight and Extended Threaded Barrel for Silencer/Sound Suppresor! [online], [dated Jul. 22, 2013], [retrieved on Jun. 10, 2016], Retrieved from the internet: <URL: http://www.defensereview.com/fn-fnx-45-tactical-45-acp-polymer-framed-combattactical-pistol-with-trijicon-rmr-ruggedized-miniature-reflex-rm02-mini-red-dot-optical-sight/>.

Black FNP 45 Tactical [online], [dated Sep. 24, 2010], Retrieved from the internet: <URL: http://www.handgunsmag.com/uncategorized/hg_lipsey_080210wo/>.

Armymedicdad, New FNH Handguns for 2010 [online], [dated Nov. 22, 2009], [retrieved on Jun. 10, 2016], Retrieved from the internet: <URL: https://www.ar15.com/archive/topic.html?b=5&f=53&t=86055>.

Goteron, Red Dot Sights for Handguns—p. 12 [online], Lightfighter Tactical Forum, [dated Jan. 31, 2012 & Feb. 1, 2012], [retrieved on Nov. 28, 2016], Retrieved from the internet: <URL: http://www.lightfighter.net/topic/red-dot-sights-for-handguns?page=12>.

Goteron, Red Dot Sights for Handguns—p. 13 [online], Lightfighter Tactical Forum, [dated Feb. 1, 2012 & Feb. 2, 2012], [retrieved on Nov. 28, 2016], Retrieved from the internet: <URL: http://www.lightfighter.net/topic/red-dot-sights-for-handguns?page=13>.

Goteron, Red Dot Sights for Handguns—p. 14 [online], Lightfighter Tactical Forum, [dated Feb. 5, 2012 & Feb. 7, 2012], [retrieved on Nov. 28, 2016], Retrieved from the internet: <URL: http://www.lightfighter.net/topic/red-dot-sights-for-handguns?page=14>.

* cited by examiner

SECTION A-A

ADAPTER PLATE SYSTEM FOR MOUNTING OPTICAL SIGHTS

CROSS REFERENCE TO RELATED APPLICATION

This application claims the benefit of U.S. Provisional Application Ser. No. 62/632,458, which was filed on Feb. 20, 2018, the entirety of which is incorporated herein by reference.

TECHNICAL FIELD

This disclosure relates to implementations of an adapter plate system for mounting optical sights on a pistol.

BACKGROUND

The vast majority of pistols come from the factory with iron sights. Typical iron sights provided on a pistol include a front post and a rear notch which must be aligned to aim the pistol. Mounting an optical sight on a pistol offers a shooter several advantages over using iron sights alone. Optical sights provide a simplified sight picture comprised of a single illuminated aiming point in place of the front post and rear notch of iron sights. In this way, a shooter's accuracy and/or speed with a pistol may improve. Further, a shooter may be able to aim with the illuminated aiming point of an optical sight in environmental conditions that would make visual alignment of the iron sights difficult or impossible, low light conditions for example.

However, given the design of most pistols, attaching an optical sight may be difficult to do. In order to accommodate an optical sight, the slide of the pistol may need to be permanently modified in order to mount an optical sight thereon, milled for example. If the user decides to switch to a new optical sight, further modifications to the pistol may be required. In some instances, the pistol may not be suitable for further modification.

Accordingly, it can be seen that needs exist for the adapter plate system for mounting optical sights on a pistol disclosed herein. It is to the provision of an adapter plate system that is configured to address these needs, and others, that the present invention in primarily directed.

SUMMARY OF THE INVENTION

Implementations of an adapter plate system for mounting optical sights on a pistol are provided. In general, the adapter plate system comprises an adapter plate configured so that an optical sight can be mounted thereon and a pistol slide having an adapter interface configured to receive the adapter plate. The adapter plate can be rotated into position between end walls of the adapter interface.

In some implementations, a pistol slide may be manufactured with an adapter interface configured in accordance with the present disclosure. In some implementations, a pistol slide may be machined, or otherwise modified, to have an adapter interface configured in accordance with the present disclosure.

An example adapter plate system for mounting optical sights on a pistol comprises: a pistol slide, the pistol slide includes an adapter interface, the adapter interface comprises a bottom surface that extends between a first end wall and a second end wall, the adapter interface includes a pivot boss that extends up from the bottom surface thereof; and an adapter plate configured so that it can be rotated into position between the first end wall and the second end wall of the adapter interface, the adapter plate comprises a mounting surface on a top side thereof and a pivot bore in an underside thereof, the mounting surface is configured so that an optical sight can be secured thereon and the pivot bore is configured to receive the pivot boss of the adapter interface therein.

Another example adapter plate system for mounting optical sights on a pistol comprises: a pistol slide, the pistol slide includes an adapter interface, the adapter interface comprises a pivot boss and a rotation stop that are a single unitary piece extending up from a bottom surface thereof, the bottom surface of the adapter interface extends between a first end wall and a second end wall; and an adapter plate configured so that it can be rotated into position between the first end wall and the second end wall of the adapter interface, the adapter plate comprises a mounting surface on a top side thereof and a guide feature in an underside thereof, the mounting surface is configured so that an optical sight can be secured thereon and the guide feature is configured to interface with the pivot boss and the rotation stop of the adapter interface.

Yet another example adapter plate system for mounting optical sights on a pistol comprises: a pistol slide, the pistol slide includes an adapter interface, the adapter interface comprises a bottom surface that extends between a first end wall and a second end wall, the adapter interface includes a pivot bore in the bottom surface thereof; and an adapter plate configured so that it can be rotated into position between the first end wall and the second end wall of the adapter interface, the adapter plate comprises a mounting surface on a top side thereof and a pivot boss that extends from an underside thereof, the mounting surface is configured so that an optical sight can be secured thereon. The pivot bore of the adapter interface is configured to receive the pivot boss of the adapter plate therein.

Still yet another example adapter plate system for mounting optical sights on a pistol comprises: a pistol slide, the pistol slide includes an adapter interface, the adapter interface comprises a bottom surface that extends between a first end wall and a second end wall, the adapter interface includes a guide feature in the bottom surface thereof; and an adapter plate configured so that it can be rotated into position between the first end wall and the second end wall of the adapter interface, the adapter plate comprises a mounting surface on a top side thereof and a pivot boss and a rotation stop that are a single unitary piece extending from an underside thereof, the mounting surface is configured so that an optical sight can be secured thereon. The guide feature of the adapter interface is configured to interface with the pivot boss and the rotation stop of the adapter plate.

In some implementations, the adapter plate may be configured so that it can be rotated into position between the curved end walls of the adapter interface. In some implementations, the adapter plate may comprise a top side onto which an optical sight can be mounted and an underside configured to interface with the pivot boss and the rotation stop of the adapter interface. In some implementations, the adapter plate may be any shape suitable for an optical sight to be mounted thereon.

In some implementations, the pivot bore may be a cylindrical shaped opening in the underside of the adapter plate. In this way, the pivot bore can receive therein, and rotate about, the pivot boss of the adapter interface.

In some implementations, the curved guide channel of the adapter plate is configured to receive the rotation stop of the adapter interface therein. In some implementations, the curved guide channel may be configured to limit the rotation of the adapter plate when it is being rotated into position within the adapter interface of a pistol slide.

In some implementations, the following steps may be used to secure the adapter plate to the adapter interface of the pistol slide.

Initially, the adapter plate is positioned at an offset angle relative to the longitudinal axis of the pistol slide so that the pivot boss and the rotation stop of the adapter interface are received within the pivot bore and the guide channel, respectively, in the underside of the adapter plate. Then, the adapter plate is rotated about the pivot boss until rotation is stopped by the rotation stop. The optical sight will now be aligned with the longitudinal axis of the pistol slide. Next, the slide cover plate is installed on the slide, thereby locking the adapter plate into position within the adapter interface.

In some implementations, an adapter plate system may further comprise a spring-loaded detent assembly configured to further secure the adapter plate against unintentional rotation once it has been positioned within the adapter interface of the pistol slide. In some implementations, the spring-loaded detent assembly comprises a detent, a spring, and an assembly retainer.

In some implementations, the assembly retainer may be configured to retain the spring and detent within a bore extending through the adapter interface of the pistol slide. In this way, the spring may be positioned to bias the detent towards a first end of the bore and thereby cause a portion of the detent to protrude from the first end of the bore. In some implementations, the bore in the bottom surface of the adapter interface is positioned so that the protruding portion of the detent can be received within a detent catch located in the underside of the adapter plate. In this way, the spring-loaded detent assembly may be used to prevent, or minimize, the rotational and/or longitudinal movement of the adapter plate once it has been positioned within the adapter interface of the pistol slide.

In another example implementation of an adapter plate system, the pivot boss and the rotation stop extend from the underside of the adapter plate, and the pivot bore and the curved guide channel are located in the bottom surface of the adapter interface.

In still yet another example implementation of an adapter plate system, the rotation stop may be integrated with the pivot boss. Further, in some implementations, the first end and/or the second end of the adapter plate may include an indexing spring configured to further secure the adapter plate in position within the adapter interface of the pistol slide.

In some implementations, the pivot boss and the rotation stop extending up from the adapter interface are a single unitary piece configured to be received within a guide feature in the underside of the adapter plate. In this way, the adapter plate can rotate about the pivot boss while the rotation stop acts as an indexing feature configured to limit the rotation of the adapter plate when it is being rotated into position within the adapter interface of the pistol slide.

In some implementations, the guide feature in the underside of the adapter plate may comprise a semi-circular pivot bore that has a fan-shaped guide channel extending therefrom. In this way, while the pivot boss and the rotation stop of the adapter interface are positioned within the semi-circular pivot bore and the fan-shaped guide channel of the adapter plate, respectively, the adapter plate can be rotated into position within the adapter interface.

BRIEF DESCRIPTION OF THE DRAWINGS

Like reference numerals refer to corresponding parts throughout the several views of the drawings.

DETAILED DESCRIPTION

FIGS. 1A-1D illustrate an example implementation of an adapter plate system 100 for mounting optical sights on a pistol according to the principles of the present disclosure. Through the use of interchangeable adapter plates configured to receive optical sights thereon, a user may change the optical sight mounted on a pistol slide by changing the adapter plate secured to the adapter interface of the pistol slide. In this way, further modification to the pistol slide is not required to accommodate a variety of optical sights.

Figure 1A:
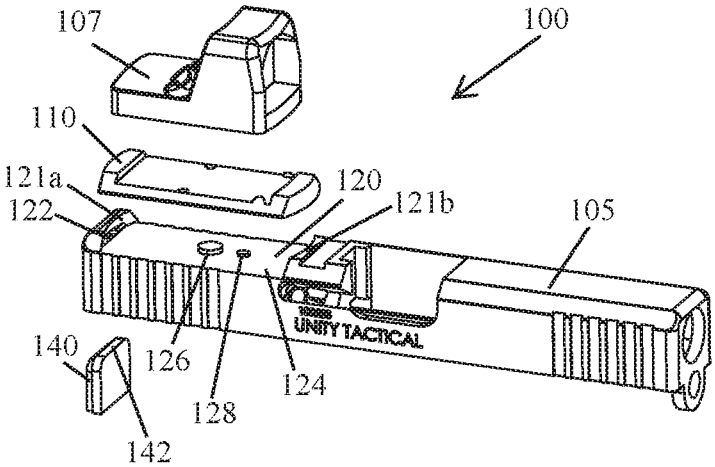
FIGS. 1A-1D illustrate an example adapter plate system for mounting optical sights on a pistol according to the principles of the present disclosure.

As shown in FIG. 1A, in some implementations, the adapter plate system 100 may comprise an adapter plate 110, a pistol slide (e.g., pistol slide 105) having an adapter interface 120 configured to receive the adapter plate 110, and a slide cover plate 140 configured to prevent the adapter plate 110 from rotating. In some implementations, an adapter plate 110 may be configured so that an optical sight (e.g., optical sight 107) can be mounted thereon.

In some implementations, a pistol slide 105 may be manufactured with an adapter interface 120 configured in accordance with the present disclosure. In some implementations, a pistol slide 105 may be machined, or otherwise modified, to have an adapter interface 120 configured in accordance with the present disclosure.

Figure 2A:
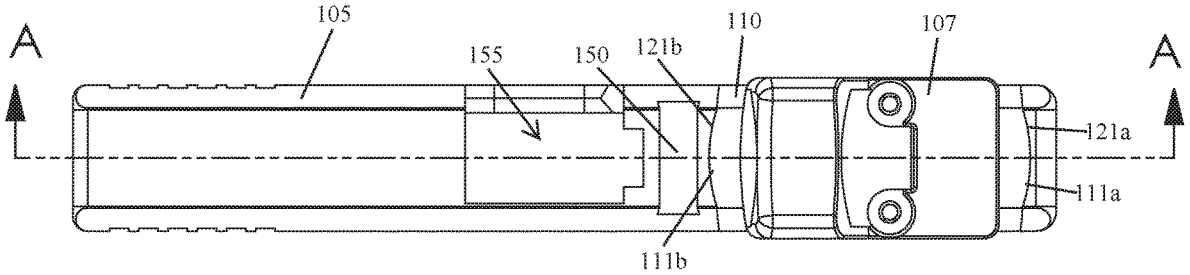
FIG. 2A illustrates a top view of the adapter plate system shown in FIG. 1D, wherein the adapter plate (with an optical sight mounted thereon) is positioned within the adapter interface of the pistol slide.
Figure 2B:
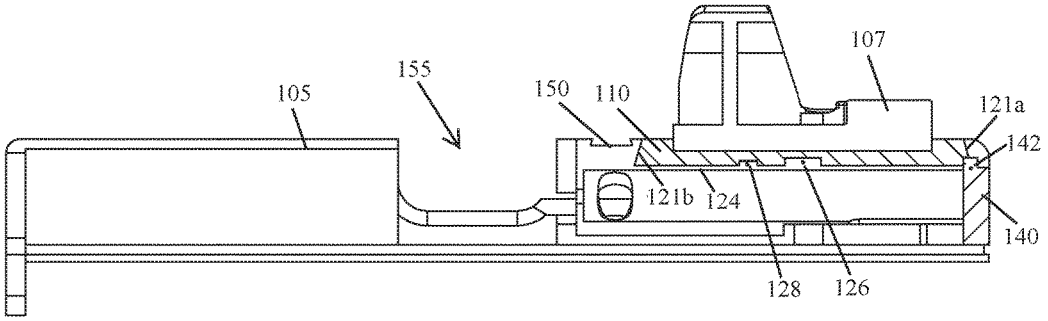
FIG. 2B illustrates a cross-sectional view of the adapter plate system taken along line A-A of FIG. 2A.

As shown in FIGS. 1A and 2B, in some implementations, the adapter interface 120 may comprise a bottom surface 124 having a pivot boss 126 and a rotation stop 128 extending therefrom, the bottom surface 124 extends between a first end wall 121*a* and a second end wall 121*b* (collectively end walls 121).

As shown in FIG. 2B, in some implementations, the bottom surface 124 of the adapter interface 120 is recessed below the top surface of the pistol slide 105. In this way, an optical sight (e.g., optical sight 107) attached to an adapter plate 110 sits lower on the pistol slide 105 than would an optical sight mounted on the top surface of the pistol slide 105. In some implementations, the depth of the bottom surface 124 of the adapter interface 120 may be limited by the amount of material that can be removed and/or omitted without compromising the structural integrity of the pistol slide.

As shown in FIG. 1A, in some implementations, the pivot boss 126 may be a cylindrical structure extending up from the bottom surface 124 of the adapter interface 120. In some implementations, the pivot boss 122 may be a tapered structure extending up from the bottom surface 124 of the adapter interface 120 (not shown). In some implementations, the pivot boss 126 is positioned on the bottom surface 124 of the adapter interface 120 so that it can be received within a pivot bore 112 in the underside of the adapter plate 110 (see, e.g., FIGS. 2B and 3B). In some implementations, the pivot boss 126 may be positioned in the center of the bottom surface 124 of the adapter interface 120 (see, e.g., FIG. 1A). In some implementations, the pivot boss 126 may be positioned at any point on the bottom surface 124 of the adapter interface 120, provided that the pivot bore 112 of the adapter plate 110 is able to receive the pivot boss 126 therein and the adapter plate 110 can be rotated into position within the adapter interface 120. In some implementations, the pivot boss 126 may be configured to prevent an adapter plate 110 from sliding back and forth within the adapter interface 120 due to the incidental vibrations associated with the discharge of a pistol.

As shown in FIG. 1A, in some implementations, the rotation stop 128 may be a cylindrical structure extending up from the bottom surface 124 of the adapter interface 120. In some implementations, the rotation stop 128 is positioned on the bottom surface 124 of the adapter interface 120 so that it can be received within a curved guide channel 114 located in the underside of the adapter plate 110 (see, e.g., FIGS. 2B and 3B). In some implementations, the rotation stop 128 may be positioned at any point on the bottom surface 124 of the adapter interface 120, provided that the guide channel 114 of the adapter plate 110 is able to receive the rotation stop 128 therein and the position of the rotation stop 128 does not prevent the adapter plate 110 from being rotated into position within the adapter interface 120. In some implementations, the rotation stop 128 may be any structure suitably shaped for being operably received within the curved guide channel 117 in the underside of the adapter plate 110.

Figure 1B:
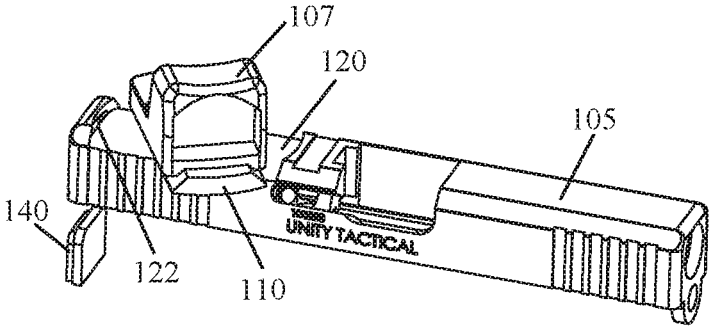
Figure 1C:
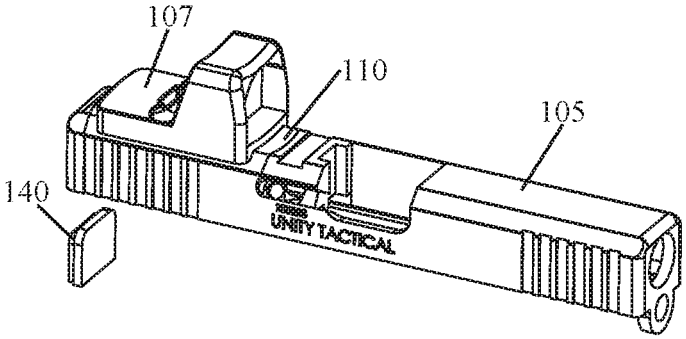

As shown in FIGS. 2A and 2B, in some implementations, the adapter interface 120 of the pistol slide 105 may be configured to receive an adapter plate 110 therein. In some implementations, the end walls 121*a*, 121*b* of the adapter interface 120 may be configured to interface with the curved ends 111*a*, 111*b* of the adapter plate 110. In some implementations, each end wall 121*a*, 121*b* of the adapter interface 120 may be curved along its length and thereby configured so that the adapter plate 110 can be rotated into position within the adapter interface 120 (see, e.g., FIGS. 1B-1C). In some implementations, at least a portion of the first end wall 121*a* and/or the second end wall 121*b* of the adapter interface 120 may extend from the bottom surface 124 at an angle (see, e.g., FIG. 2B). In some implementations, each end wall 121*a*, 121*b* of the adapter interface 120 may be configured to form the female portion of a joint and each end 111*a*, 111*b* of the adapter plate 110 may be configured to form the male portion of a joint (see, e.g., FIGS. 2A and 2B). In this way, a secure connection may be achieved when the adapter plate 110 is rotated into position within the adapter interface 120.

Although not shown, in some implementations, the first end wall 121*a* and the second end wall 121*b* of the adapter interface 120 may each be a groove configured to receive therein the first end 111*a* and the second end 111*b*, respectively, of the adapter plate 110. In some implementations, the adapter interface 120 may be any shape suitable for receiving an adapter plate 110 therein.

As shown in FIG. 1A, in some implementations, the first end wall 121*a* of the adapter interface 120 may include a slot 122 that extends therethrough. In this way, when the slide cover plate 140 is installed on the pistol slide 105, a portion of the slide cover plate 140 extends into the slot 122 and interfaces with the first end 121*a* of the adapter plate 110 (see, e.g., FIG. 2B). In some implementations, the slot 122 of the first end wall 121*a* may be any suitable shape.

Figure 3B:
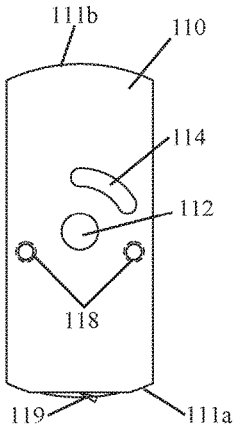
FIGS. 3A and 3B illustrate an example adapter plate according to the principles of the present disclosure.
Figure 3A:
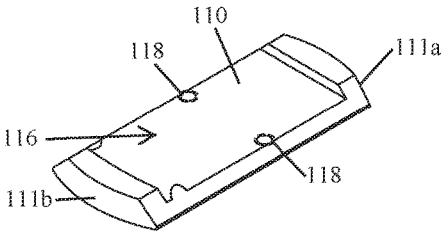

As shown in FIGS. 3A and 3B, in some implementations, the adapter plate 110 may be configured so that it can be rotated into position between the curved end walls 121 of the adapter interface 120. In some implementations, the adapter plate 110 may comprise a top side (see, e.g., FIG. 3A) onto which an optical sight 107 can be mounted and an underside configured to interface with the pivot boss 126 and the rotation stop 128 of the adapter interface 120 (see, e.g., FIG. 3B).

As shown in FIG. 3A, in some implementations, the adapter plate 110 may have the general shape of a rectangle. In some implementations, the top side of the adapter plate 110 includes a mounting surface 116 configured to receive an optical sight 107 thereon. In some implementations, the mounting surface 116 of the adapter plate 110 may be any shape suitable for mounting an optical sight thereon. In some implementations, the adapter plate 110 may include one or more openings 118 therein (see, e.g. FIGS. 3A and 3B). In this way, fasteners (e.g., screws) may be used to secure an optical sight 107 onto the mounting surface 116 of the adapter plate 110. In some implementations, an optical sight may have an aiming point illuminated by electricity, tritium, a light emitting chemical reaction, or a combination thereof. In some implementations, the optical sight may be an Aimpoint® Micro optical sight, a DOCTER® red dot sight, a Leupold® Deltapoint, a Trijicon RMR®, or other optical sight having a similar foot print that is currently known or developed in the future.

In some implementations, the top side of the adapter plate 110 may include a recoil lug thereon. In this way, an attached optical sight may be prevented from sliding back and forth due to the incidental vibrations associated with the discharge of a pistol.

As shown in FIG. 3B, in some implementations, the pivot bore 112 may be a cylindrical shaped opening in the underside of the adapter plate 110. In some implementations, the pivot bore 112 may be any shape suitable for receiving therein, and rotating about, the pivot boss 126. In some implementations, the pivot bore 112 is positioned on the underside of the adapter plate 112 so that it can receive, and pivot on, the pivot boss 126 of the adapter interface 120 (see, e.g., FIG. 2B). In some implementations, the pivot bore 112 may be positioned in, or near, the center of the underside of the adapter plate 110 (see, e.g., FIG. 3B). In some implementations, the pivot bore 112 may be positioned at any point on the underside of the adapter plate 110, provided that the pivot bore 112 of the adapter plate 110 is able to receive the pivot boss 126 therein and the adapter plate 110 can be rotated into position within the adapter interface 120.

As shown in FIG. 3B, in some implementations, the curved guide channel 114 of the adapter plate 110 may be any shape suitable for receiving the rotation stop 128 of the adapter interface 120 therein. In some implementations, the curved guide channel 114 may be configured to limit the rotation of the adapter plate 110 when it is being rotated into position within the adapter interface 120 of a pistol slide 105. In some implementations, the curved guide channel 114 is positioned on the underside of the adapter plate 110 so that the rotation stop 128 is positioned therein during assembly of the adapter plate system 100. In this way, rotation of the adapter plate 110 is limited by the length of the curved guide channel 114.

As shown in FIGS. 2B and 3B, in some implementation the first end 111*a* of the adapter plate 110 may be configured to interface with the portion of the slide cover plate 140 that extends into the slot 122 of the first end wall 121*a* of the adapter interface 120. In this way, the slide cover plate 140 may be used to prevent the adapter plate 110 from rotating while it's positioned in the adapter interface 120. In some implementations, the locking interface 119 on the first end 111*a* of the adapter plate 110 may be a flat surface. In some implementations, the locking interface 119 may be tapered/ramped (not shown). In this way, the adapter plate 110 may be longitudinally centered within the adapter interface 120.

As shown in FIG. 2B, in some implementations, the slide cover plate 140 of the adapter plate system 100 may be configured to interface with the first end 111*a* of the adapter plate 110. In this way, the slide cover plate 140 may be used to prevent the adapter plate 110 from rotating while it is positioned within the adapter interface 120 of the pistol slide 105. In some implementations, the slide cover plate 140 may include a lip 142 thereon, or other similar feature, that interfaces with the first end 111*a* of the adapter plate 110. In some implementations, the slide cover plate 140 may be the same as, or similar to, the slide cover plate of a Glock® pistol, which is well known to those of ordinary skill in the art.

As shown in FIGS. 1A and 1B, in some implementations, the following steps may be use to secure an optical sight 107 to the adapter plate 110.

Initially, as shown in FIG. 1A, the optical sight 107 may be oriented so that the openings 118 in the adapter plate 110 are aligned with openings that extend into, or through, the optical sight 107.

Then, the optical sight 107 is positioned on the mounting surface 116 of the adapter plate 110.

Next, fasteners (e.g., screws) may be used to secure the optical sight 107 to the mounting surface 116 of the adapter plate 110 (see, e.g., FIG. 1B).

To remove the optical sight 107 from the adapter plate 110, the above steps are performed in reverse.

Figure 1D:
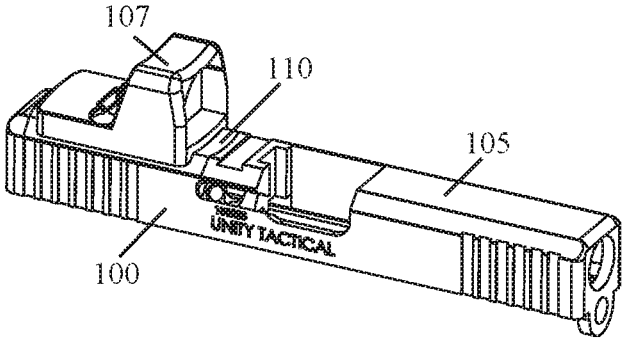

As shown in FIGS. 1B-1D, in some implementations, the following steps may be used to secure the adapter plate 110 to the adapter interface 120 of the pistol slide 105.

Initially, as shown in FIG. 1B, the adapter plate 110 is positioned at an offset angle (e.g., 60 degrees) relative to the longitudinal axis of the pistol slide 105 so that the pivot boss 126 and the rotation stop 128 are received within the pivot bore 112 and the guide channel 114, respectively, in the underside thereof. The degree of offset required to begin installation of the adapter plate 110 is, at least in part, a function of the guide channel's 114 configuration (e.g., length, position, etc).

Then, as shown in FIG. 1B, the adapter plate 110 is rotated about the pivot boss 126 until rotation is stopped by the rotation stop 128. The optical sight 107 will now be aligned with the longitudinal axis of the pistol slide 105 (see, e.g., FIG. 2A).

Next, as shown in FIG. 1D, the slide cover plate 140 is installed on the slide 105, thereby locking the adapter plate 110 into position within the adapter interface 120.

To remove the adapter plate 110 from the adapter interface 120, the above steps are performed in reverse.

In some implementations, the adapter plate 110 may be configured so that one or more fasteners can be inserted through openings (e.g., openings 118) therein, from the underside thereof, and threadedly secured to corresponding openings located in the bottom side of an optical sight. In this way, for example, an optical sight such as an Aimpoint® Micro may be mounted to an adapter plate 110.

As shown in FIG. 2B, in some implementations, a dovetail 150 may be positioned between the ejection port 155 and the adapter interface 120 of the pistol slide 105. In some implementations, the dovetail 150 may be configured to receive a rear sight therein (not shown). In this way, iron sights may be used in conjunction with one or more implementations of the adapter plate system 100 disclosed herein.

In some implementations, an optical sight (e.g., optical sight 107) mounted on an adapter plate 110 of the adapter plate system 100 may sit low enough within the adapter interface 120 that a user is able to align the iron sights of a pistol while looking through the optical sight 107.

Figure 4A:
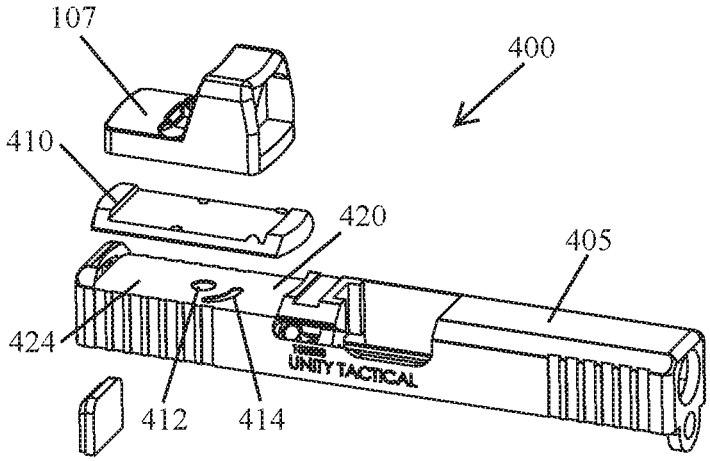
FIGS. 4A and 4B illustrate another example adapter plate system for mounting optical sights on a pistol according to the principles of the present disclosure.
Figure 4B:
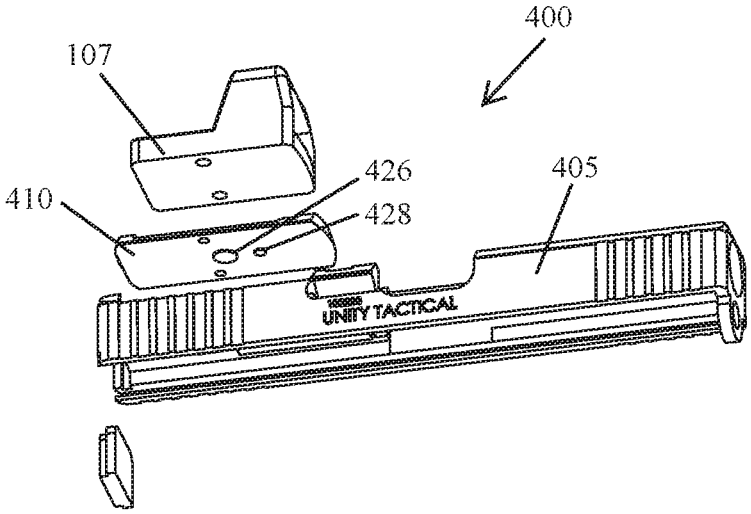

FIGS. 4A and 4B illustrate another example implementation of an adapter plate system 400 according to the principles of the present disclosure. In some implementations, the adapter plate system 400 is similar to the adapter plate system 100 discussed above but the pivot boss 426 and the rotation stop 428 extend from the underside of the adapter plate 410; and the pivot bore 412 and the curved guide channel 414 are located in the bottom surface 424 of the adapter interface 420. In this way, the adapter interface 420 of the pistol slide 405 may be configured to rotatably receive the adapter plate 410 therein.

FIGS. 5A-5D illustrate yet another example implementation of an adapter plate system 500 according to the principles of the present disclosure. In some implementations, the adapter plate system 500 is similar to the adapter plate systems 100, 400 discussed above, in particular the adapter plate system 100 shown in FIGS. 1A-1D and 2A-2B, but further comprises a spring-loaded detent assembly 560 configured to further secure the adapter plate 510 against unintentional rotation once it has been positioned within the adapter interface 520 of the pistol slide 505.

Figure 5A:
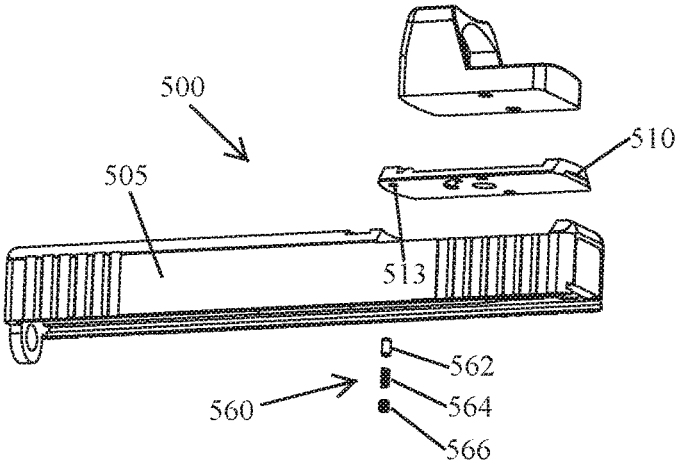
FIGS. 5A-5D illustrate yet another example adapter plate system for mounting optical sights on a pistol according to the principles of the present disclosure.
Figure 5B:
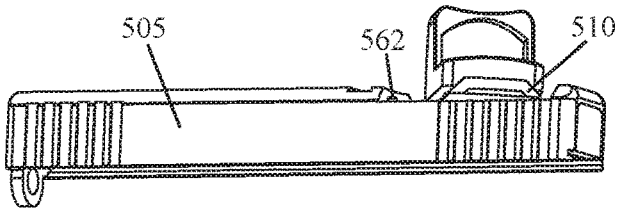
Figure 5C:
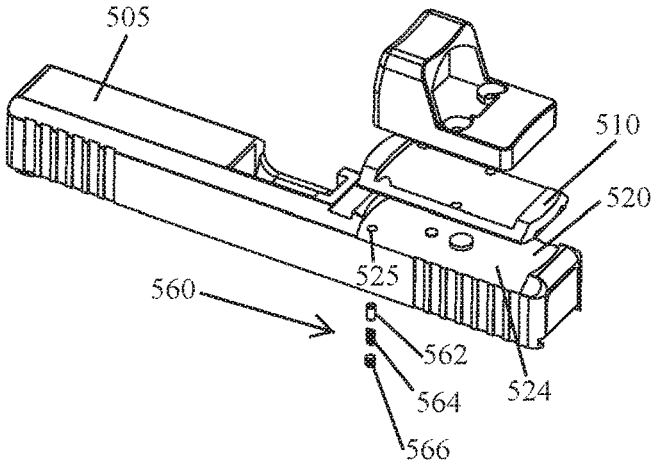
Figure 5D:
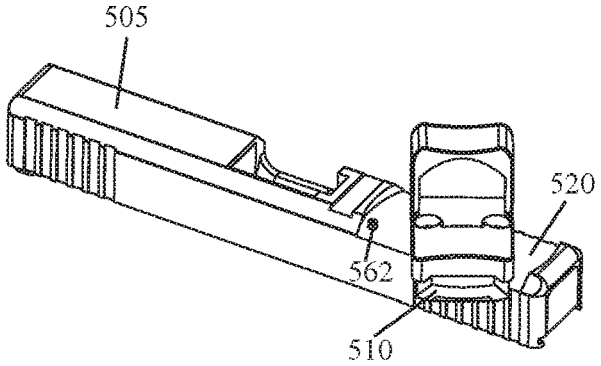

As shown in FIGS. 5A and 5C, in some implementations, the spring-loaded detent assembly 560 comprises a detent 562, a spring 564, and an assembly retainer 566 (e.g., a set screw).

In some implementations, the assembly retainer 566 may be configured to retain the spring 564 and detent 562 within a bore 525 extending through the adapter interface 520 of the pistol slide 505 (see, e.g., FIG. 5C). In this way, the spring 564 may be positioned to bias the detent 562 towards a first end of the bore 525 and thereby cause a portion of the detent 562 to protrude from the first end of the bore 525 (see, e.g., FIGS. 5B and 5D). In some implementations, the bore 525 in the bottom surface 524 of the adapter interface 520 is positioned so that the protruding portion of the detent 562 can be received within a detent catch 513 located in the underside of the adapter plate 510 (see, e.g., FIG. 5A). In this way, the spring-loaded detent assembly 560 may be used to prevent, or minimize, the rotational and/or longitudinal movement of the adapter plate 510 once it has been positioned within the adapter interface 520 of the pistol slide 505.

In some implementations, the detent catch 513 may be a bore in the underside of the adapter plate 510 configured to receive the portion of the detent 562 extending from the first end of the bore 525 in the adapter interface 520. In some implementations, the detent catch 513 in the underside of the adapter plate 510 may be any shape suitable for removably receiving the protruding portion of the detent 562 therein.

In some implementations, an adapter plate system may be configured so that the spring-loaded detent assembly 560 is used to secure the adapter plate 510 within the adapter interface 520 in-lieu of a slide cover plate. In such an implementation, there would be no need to include a locking interface (e.g., locking interface 119) on the first end of the adapter plate (e.g., adapter plate 110) or a slot (e.g., slot 122) that extends through the first end wall of the adapter interface (e.g., adapter interface 120).

In some implementations, an adapter plate system may be configured so that a spring-loaded detent assembly 560 is used in conjunction with a slide cover plate to secure the adapter plate 510 in position within the adapter interface 520.

FIGS. 6A-6D and 7A-7B illustrate still yet another example implementation of an adapter plate system 600 according to the principles of the present disclosure. In some implementations, the adapter plate system 600 is similar to the adapter plate systems 100, 400, 500 discussed above, but the rotation stop 628 has been integrated with the pivot boss 626. Further, in some implementations, the first end 611*a* and/or the second end 611*b* of the adapter plate 610 may include an indexing spring 670 configured to further secure the adapter plate 610 in position within the adapter interface 620 of the pistol slide 605.

Figure 6A:
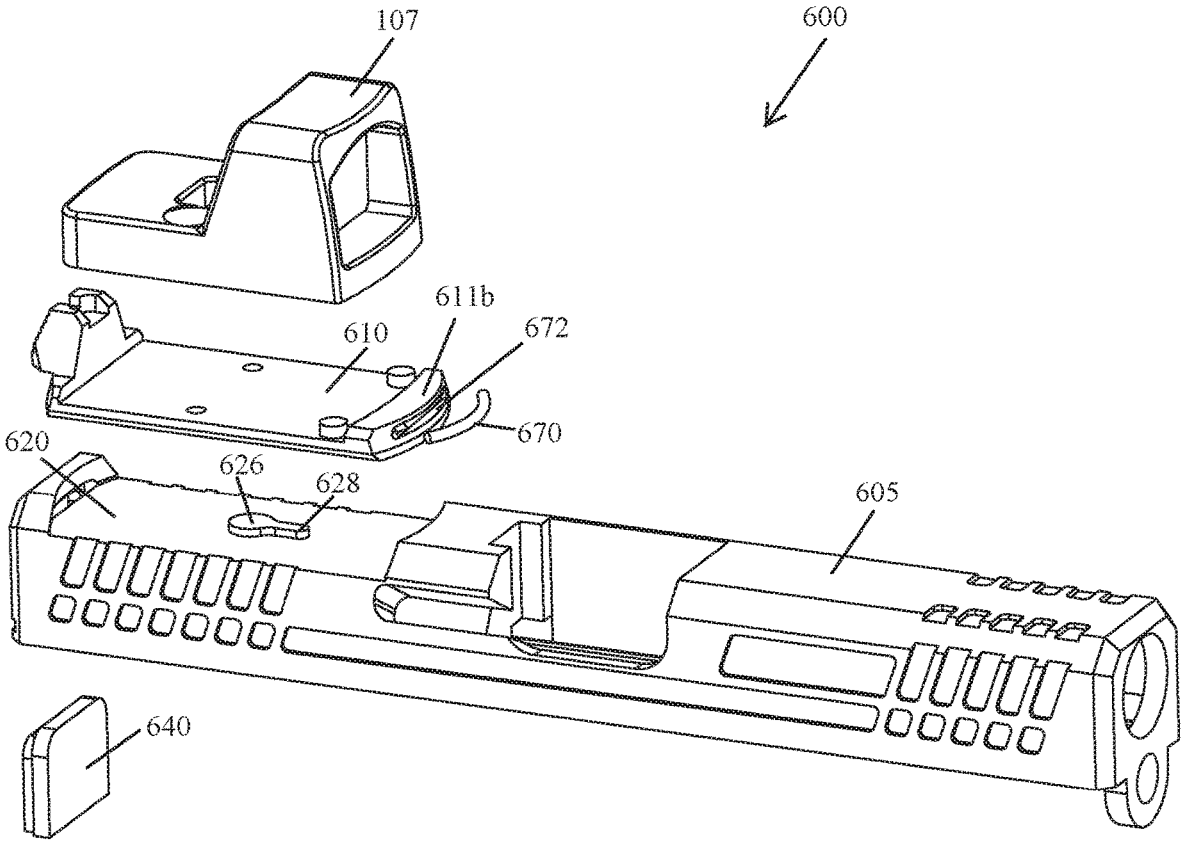
FIG. 6A-6D illustrate still yet another example adapter plate system for mounting optical sights on a pistol according to the principles of the present disclosure.

As shown in FIG. 6A, in some implementations, the pivot boss 626 and the rotation stop 628 extending up from the adapter interface 620 are a single unitary piece configured to be received within a guide feature 630 in the underside of the adapter plate 610. In this way, the adapter plate 610 can rotate about the pivot boss 626 while the rotation stop 628 acts as an indexing feature configured to limit the rotation of the adapter plate 610 when it is being rotated into position within the adapter interface 620 of the pistol slide 605.

Figure 6B:
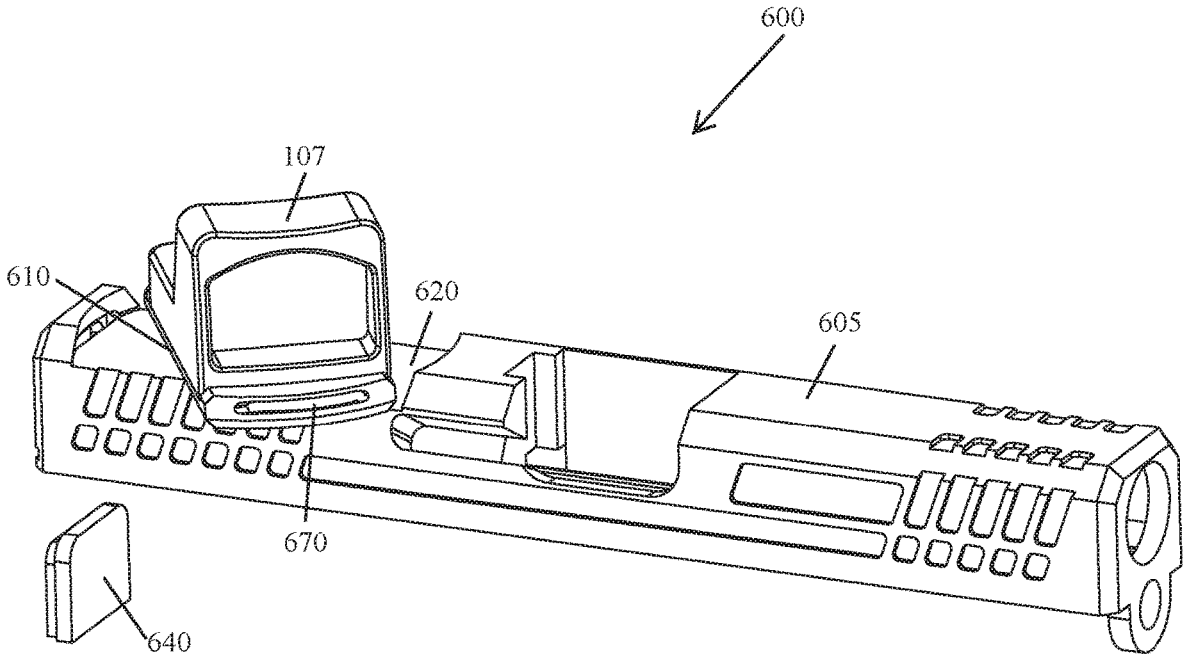
Figure 6C:
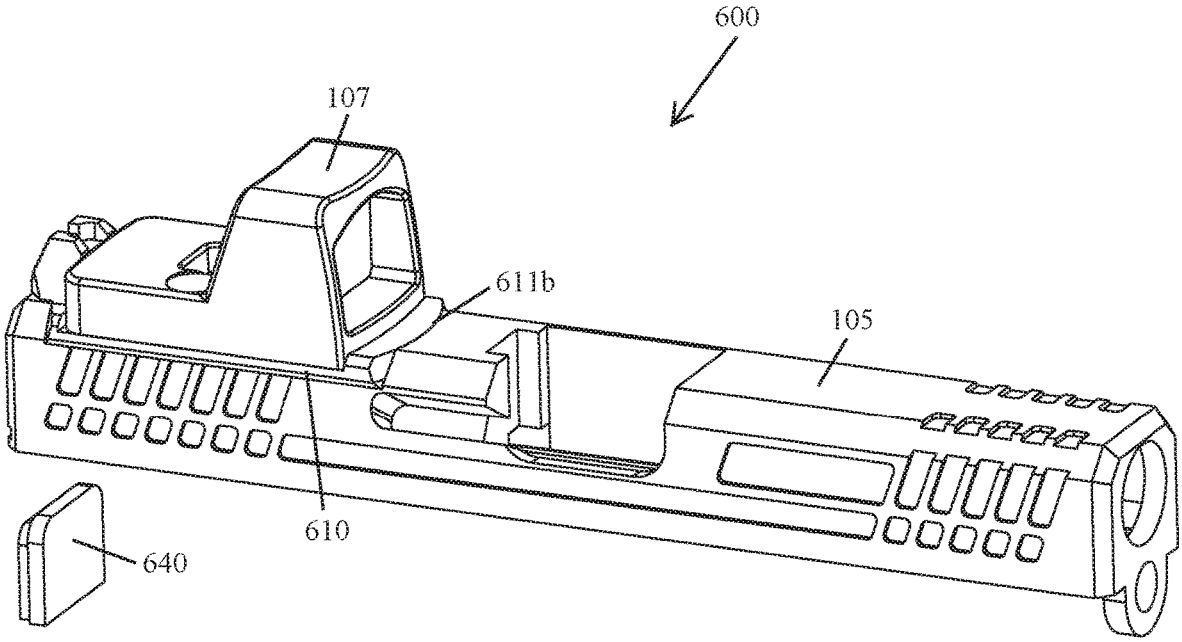
Figure 6D:
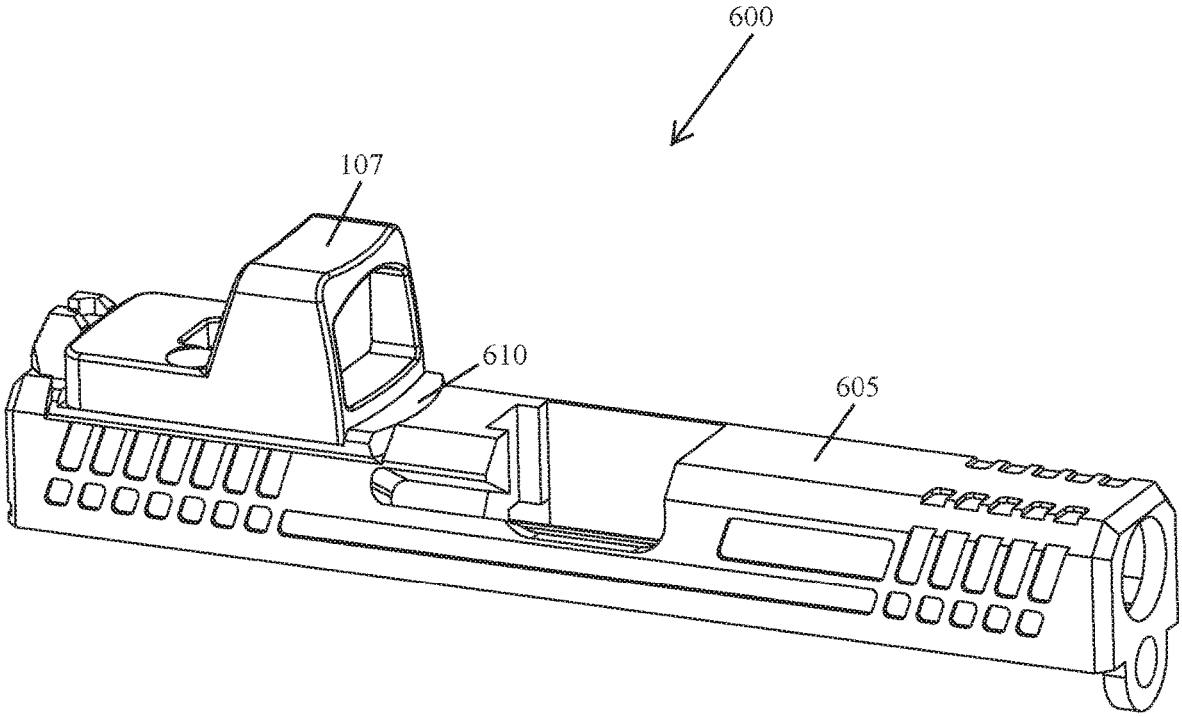
Figure 7A:
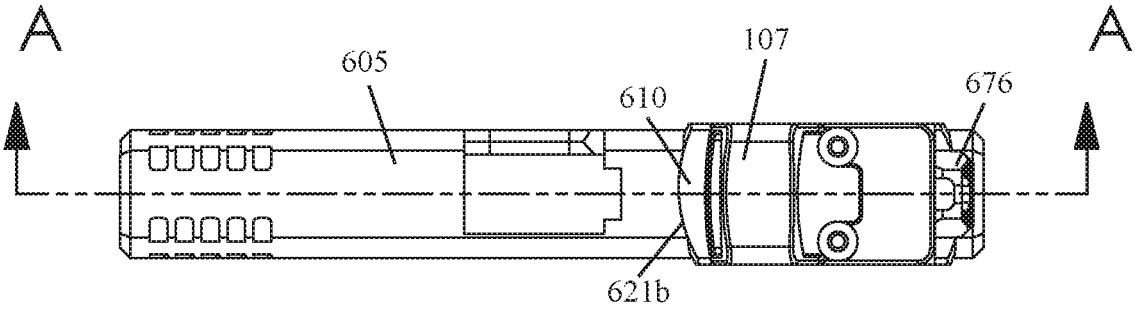
FIG. 7A illustrates a top view of the adapter plate system shown in FIG. 6D, wherein the adapter plate (with an optical sight mounted thereon) is positioned within the adapter interface of the pistol slide.
Figure 7B:
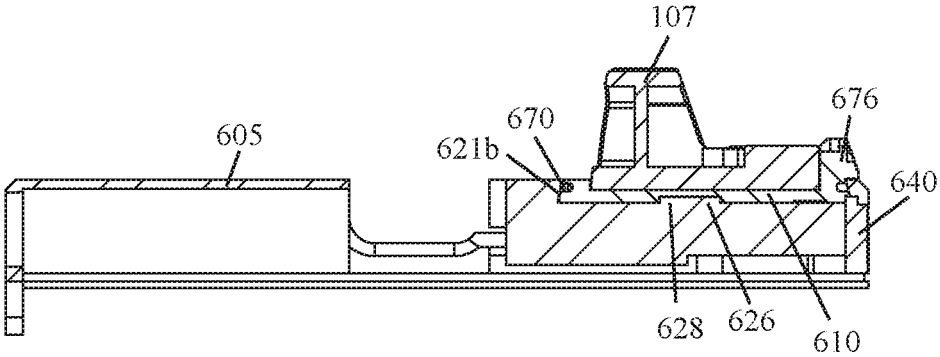
FIG. 7B illustrates a cross-sectional view of the adapter plate system taken along line A-A of FIG. 7A.

In some implementations, the first end 611*a* and/or the second end 611*b* of the adapter plate 610 may include an indexing spring 670 that is nested in a groove 672 (see, e.g., FIGS. 6A, 6B, and 7B). In some implementations, the indexing spring 670 may be positioned so that it can press (or bear) against an adjacent end wall (e.g., the second end wall 621*b*) of the adapter interface 620 (see, e.g., FIG. 7B). In this way, the indexing spring 670 is able to secure the adapter plate 610 against unintentional rotation while it's positioned within the adapter interface 620 (see, e.g., FIG. 6C). In some implementations, the adjacent end wall (e.g., the second end wall 621*b*) of the adapter interface 620 may include a groove therein that is configured to act as a catch for the indexing spring 670. In some implementations, the adapter plate 610 may not include an indexing spring 670 in either the first end 611*a* or the second end 611*b* thereof. Instead, such an implementation may rely solely on the slide cover plate 640 to secure it in position within the adapter interface 620.

Figure 8A:
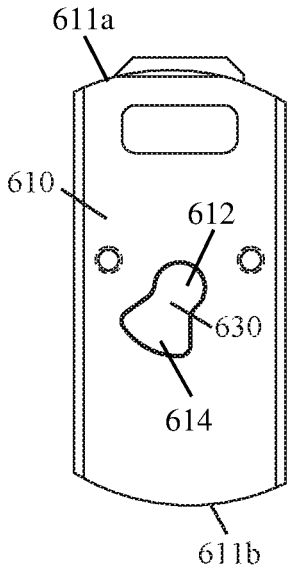
FIGS. 8A and 8B illustrate another example adapter plate according to the principles of the present disclosure.

As shown in FIG. 8A, in some implementations, the underside of the adapter plate 610 is configured to interface with the pivot boss 626 and the rotation stop 628 of the adapter interface 620. In some implementations, the guide feature 630 may comprise a semi-circular pivot bore 612 that has a fan-shaped guide channel 614 extending therefrom (see, e.g., FIG. 8A). In this way, while the pivot boss 626 and the rotation stop 628 of the adapter interface 620 are positioned within the semi-circular pivot bore 612 and the fan-shaped guide channel 614 of the adapter plate 610, respectively, the adapter plate 610 can be rotated into position within the adapter interface 620 (see, e.g., FIG. 7B).

Figure 8B:
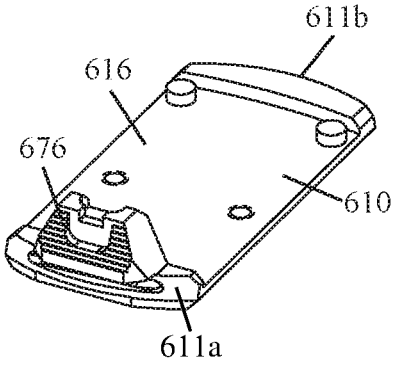

As shown in FIG. 8B, in some implementations, the adapter plate 610 may further comprise a rear sight 676. In some implementations, the rear sight 676 is positioned so that it can be used in conjunction with a front sight (not shown, but well known to those of ordinary skill in the art) mounted on the pistol slide 605 to aim the pistol. In some implementations, the adapter plate 610 may be configured so that the rear sight 676 and a corresponding front sight post can be used to aim the pistol even when an optical sight 107 is secured to the mounting surface 616. In some implementations, the adapter plate 610 may not include a rear sight 676.

In yet another example implementation of an adapter plate system, the adapter plate system may be similar to the adapter plate systems 100, 400, 500, 600 discussed above, in particular the adapter plate system 600 shown in FIGS. 6A-6D and 7A-7B, but a pivot boss with an integrated rotation stop may extend from the underside of the adapter plate; and the guide feature may be located in the bottom surface of the adapter interface. In this way, the adapter interface of the pistol slide may be configured to rotatably receive the adapter plate therein.

An adapter plate system 100, 400, 500, 600 may be configured to work with other autoloading pistols currently known or developed in the future (e.g., Smith & Wesson® M&P® model pistols and/or Sig Sauer P320® model pistols). While a Glock model pistol slide is shown throughout the illustrations, it is to be understood that the adapter plate systems 100, 400, 500, 600 disclosed herein may be integrated into any suitable autoloading pistol.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. An adapter plate system for mounting optical sights on a pistol, the adapter plate system comprising:

a pistol slide, the pistol slide includes an adapter interface, the adapter interface comprises a bottom surface that extends between a first end wall and a second end wall, the adapter interface includes a pivot boss that extends up from the bottom surface thereof; and an adapter plate configured so that it can be rotated into position between the first end wall and the second end wall of the adapter interface, the adapter plate comprises a mounting surface on a top side thereof and a pivot bore in an underside thereof, the mounting surface is configured so that an optical sight can be secured thereon and the pivot bore is configured to receive the pivot boss of the adapter interface therein.

2. The adapter plate system of claim 1, further comprising a slide cover plate, the slide cover plate is configured to interface with a first end of the adapter plate and thereby prevent the adapter plate from rotating while positioned within the adapter interface.

3. The adapter plate system of claim 2, wherein the first end wall of the adapter interface includes a slot that extends therethrough, a lip of the slide cover plate extends into the slot and interfaces with the first end of the adapter plate.

4. The adapter plate system of claim 1, wherein the adapter interface also includes a rotation stop that extends up from the bottom surface thereof, the adapter plate further comprises a curved guide channel in the underside thereof, the curved guide channel of the adapter plate is configured to receive the rotation stop of the adapter interface therein.

5. The adapter plate system of claim 1, wherein each end of the adapter plate is curved, and the first end wall and the second end wall of the adapter interface are configured so that the adapter plate can be rotated into position within the adapter interface.

6. The adapter plate system of claim 1, wherein a second end of the adapter plate includes an indexing spring that is nested in a groove, the indexing spring is configured to press against the second end wall of the adapter interface and thereby secure the adapter plate against unintentional rotation while it's positioned within the adapter interface.

7. An adapter plate system for mounting optical sights on a pistol, the adapter plate system comprising:

a pistol slide, the pistol slide includes an adapter interface, the adapter interface comprises a pivot boss and a rotation stop that are a single unitary piece extending up from a bottom surface thereof, the bottom surface of the adapter interface extends between a first end wall and a second end wall; and an adapter plate configured so that it can be rotated into position between the first end wall and the second end wall of the adapter interface, the adapter plate comprises a mounting surface on a top side thereof and a guide feature in an underside thereof, the mounting surface is configured so that an optical sight can be secured thereon and the guide feature is configured to interface with the pivot boss and the rotation stop of the adapter interface.

8. The adapter plate system of claim 7, further comprising a slide cover plate, the slide cover plate is configured to interface with a first end of the adapter plate and thereby prevent the adapter plate from rotating while positioned within the adapter interface.

9. The adapter plate system of claim 8, wherein the first end wall of the adapter interface includes a slot that extends therethrough, a lip of the slide cover plate extends into the slot and interfaces with the first end of the adapter plate.

10. The adapter plate system of claim 7, wherein the guide feature in the underside of the adapter plate comprises a semi-circular pivot bore that has a fan-shaped guide channel extending therefrom.

11. The adapter plate system of claim 7, wherein each end of the adapter plate is curved, and the first end wall and the second end wall of the adapter interface are configured so that the adapter plate can be rotated into position within the adapter interface.

12. The adapter plate system of claim 7, wherein a second end of the adapter plate includes an indexing spring that is nested in a groove, the indexing spring is configured to press against the second end wall of the adapter interface and thereby secure the adapter plate against unintentional rotation while it's positioned within the adapter interface.

13. An adapter plate system for mounting optical sights on a pistol, the adapter plate system comprising:

a pistol slide, the pistol slide includes an adapter interface, the adapter interface comprises a bottom surface that extends between a first end wall and a second end wall, the adapter interface includes a pivot bore in the bottom surface thereof; and an adapter plate configured so that it can be rotated into position between the first end wall and the second end wall of the adapter interface, the adapter plate comprises a mounting surface on a top side thereof and a pivot boss that extends from an underside thereof, the mounting surface is configured so that an optical sight can be secured thereon;

wherein the pivot bore of the adapter interface is configured to receive the pivot boss of the adapter plate therein.

14. The adapter plate system of claim 13, further comprising a slide cover plate, the slide cover plate is configured to interface with a first end of the adapter plate and thereby prevent the adapter plate from rotating while positioned within the adapter interface.

15. The adapter plate system of claim 14, wherein the first end wall of the adapter interface includes a slot that extends therethrough, a lip of the slide cover plate extends into the slot and interfaces with the first end of the adapter plate.

16. The adapter plate system of claim 13, wherein the adapter interface also includes a curved guide channel in the bottom surface thereof, the adapter plate further comprises a rotation stop that extends from the underside thereof, the curved guide channel of the adapter interface is configured to receive the rotation stop of the adapter plate therein.

17. The adapter plate system of claim 13, wherein each end of the adapter plate is curved, and the first end wall and the second end wall of the adapter interface are configured so that the adapter plate can be rotated into position within the adapter interface.

18. The adapter plate system of claim 13, wherein a second end of the adapter plate includes an indexing spring that is nested in a groove, the indexing spring is configured to press against the second end wall of the adapter interface and thereby secure the adapter plate against unintentional rotation while it's positioned within the adapter interface.

19. An adapter plate system for mounting optical sights on a pistol, the adapter plate system comprising:

a pistol slide, the pistol slide includes an adapter interface, the adapter interface comprises a bottom surface that extends between a first end wall and a second end wall, the adapter interface includes a guide feature in the bottom surface thereof; and an adapter plate configured so that it can be rotated into position between the first end wall and the second end wall of the adapter interface, the adapter plate comprises a mounting surface on a top side thereof and a pivot boss and a rotation stop that are a single unitary piece extending from an underside thereof, the mounting surface is configured so that an optical sight can be secured thereon;

wherein the guide feature of the adapter interface is configured to interface with the pivot boss and the rotation stop of the adapter plate.

20. The adapter plate system of claim 19, further comprising a slide cover plate, the slide cover plate is configured to interface with a first end of the adapter plate and thereby prevent the adapter plate from rotating while positioned within the adapter interface.

21. The adapter plate system of claim 20, wherein the first end wall of the adapter interface includes a slot that extends therethrough, a lip of the slide cover plate extends into the slot and interfaces with the first end of the adapter plate.

22. The adapter plate system of claim 19, wherein the guide feature in the bottom surface of the adapter interface comprises a semi-circular pivot bore that has a fan-shaped guide channel extending therefrom.

23. The adapter plate system of claim 19, wherein each end of the adapter plate is curved, and the first end wall and the second end wall of the adapter interface are configured so that the adapter plate can be rotated into position within the adapter interface.

24. The adapter plate system of claim 19, wherein a second end of the adapter plate includes an indexing spring that is nested in a groove, the indexing spring is configured to press against the second end wall of the adapter interface and thereby secure the adapter plate against unintentional rotation while it's positioned within the adapter interface.

* * * * *